US009410307B2

(12) United States Patent
Fukuda et al.

(10) Patent No.: US 9,410,307 B2
(45) Date of Patent: Aug. 9, 2016

(54) HYBRID CONSTRUCTION MACHINE

(71) Applicant: KAYABA INDUSTRY CO., LTD., Tokyo (JP)

(72) Inventors: Shunsuke Fukuda, Kanagawa (JP); Nobuyoshi Yoshida, Tokyo (JP)

(73) Assignee: KYB Corporation, Tokyo (JP)

( * ) Notice: Subject to any disclaimer, the term of this patent is extended or adjusted under 35 U.S.C. 154(b) by 278 days.

(21) Appl. No.: 14/374,281

(22) PCT Filed: Jan. 24, 2013

(86) PCT No.: PCT/JP2013/051433
§ 371 (c)(1),
(2) Date: Jul. 24, 2014

(87) PCT Pub. No.: WO2013/115053
PCT Pub. Date: Aug. 8, 2013

(65) Prior Publication Data

US 2015/0033727 A1 Feb. 5, 2015

(30) Foreign Application Priority Data

Feb. 3, 2012 (JP) ..... 2012-022286

(51) Int. Cl.

| | |
|---|---|
| ***E02F 9/22*** | (2006.01) |
| ***F15B 21/14*** | (2006.01) |
| ***F15B 11/17*** | (2006.01) |
| ***E02F 9/20*** | (2006.01) |
| ***F15B 7/00*** | (2006.01) |
| ***F15B 11/08*** | (2006.01) |
| ***F15B 21/00*** | (2006.01) |

(52) U.S. Cl.

CPC ..... *E02F 9/2292* (2013.01); *E02F 9/2095* (2013.01); *E02F 9/2217* (2013.01); *E02F 9/2242* (2013.01); *E02F 9/2267* (2013.01); *E02F 9/2296* (2013.01); *F15B 7/001* (2013.01); *F15B 11/08* (2013.01); *F15B 11/17* (2013.01); *F15B 21/001* (2013.01); *F15B 21/14* (2013.01); *F15B 2211/20576* (2013.01); *F15B 2211/2654* (2013.01); *F15B 2211/355* (2013.01); *F15B 2211/40515* (2013.01); *F15B 2211/40546* (2013.01); *F15B 2211/40576* (2013.01)

(58) Field of Classification Search

CPC ..... F15B 11/17; F15B 21/14; F15B 2211/20576; E02F 9/2075; E02F 9/2292; E02F 9/2239; E02F 9/2242

See application file for complete search history.

(56) References Cited

U.S. PATENT DOCUMENTS

| | | | | |
|---|---|---|---|---|
| 5,852,934 | A | 12/1998 | Chung et al. | |
| 8,321,095 | B2 * | 11/2012 | Kawasaki | E02F 9/2075 701/36 |
| 2009/0288408 | A1 * | 11/2009 | Tozawa | E02F 9/2075 60/435 |

FOREIGN PATENT DOCUMENTS

| | | | |
|---|---|---|---|
| JP | 61-13006 | A | 1/1986 |
| JP | 09-268604 | A | 10/1997 |
| JP | 2011-163291 | | 8/2011 |
| JP | 2011-174491 | | 8/2011 |
| JP | 2011-241947 | | 12/2011 |
| WO | WO 2011/099401 | A1 | 8/2011 |

* cited by examiner

*Primary Examiner* — Michael Leslie
*Assistant Examiner* — Michael Quandt
(74) *Attorney, Agent, or Firm* — Rabin & Berdo, P.C.

(57) ABSTRACT

A hybrid construction machine includes first and second main pumps, first and second supply passages, first and second circuit systems, a hydraulic motor, a motor generator, an assist pump, a joint passage connected to the assist pump and branched off, first and second logic valves, a switching valve disposed in the other branch passage and switchable to a state where the assist pump is connected to the second supply passage on the upstream side of the second logic valve and a state where the second main pump is connected to the hydraulic motor, and a check valve. A poppet diameter of the first logic valve is smaller than that of the second logic valve.

4 Claims, 2 Drawing Sheets

HYBRID CONSTRUCTION MACHINE

TECHNICAL FIELD

The present invention relates to a hybrid construction machine.

BACKGROUND ART

JP2011-241947A discloses a hybrid construction machine capable of adding a discharge pressure of an assist pump driven by a motor to discharge pressures of main pumps driven by an engine. The hybrid construction machine includes a first and a second variable-capacity type main pump.

The first main pump is connected to a first circuit system by way of a first supply passage and a plurality of operation valves are connected to the first circuit system. An output port of a first logic valve is connected to the first supply passage. An input port of the first logic valve constantly communicates with the assist pump of the variable-capacity type by way of a joint passage.

The second main pump is connected to a second circuit system by way of a second supply passage and a plurality of operation valves are connected to the second circuit system. A second logic valve is disposed in the second supply passage. An input port of the second logic valve is connected to the second main pump via a second supply passage on the upstream side of the second logic valve. An output port of the second logic valve is connected to the second circuit system via the second supply passage on the downstream side of the second logic valve.

The assist pump of the variable-capacity type integrally rotates in coordination with a hydraulic motor and a motor generator of the variable-capacity type. The motor generator is connected to a battery via an inverter. Thus, if the hydraulic motor rotates, the motor generator rotates to generate power and the generated power is stored into the battery via the inverter.

A switching valve is connected to the second supply passage. The switching valve is normally kept at a neutral position by the action of a centering spring and allows the joint passage communicating with the assist pump to communicate with the second supply passage by way of a branch passage. A check valve for permitting only a flow from the switching valve to the second supply passage is provided in the branch passage.

Accordingly, when the switching valve is at the neutral position, the first and second logic valves are connected in parallel to the joint passage.

SUMMARY OF INVENTION

In the above conventional technology, the assist pump is connected in parallel to the first and second main pumps via the joint passage. Out of the main pumps, the assist pump is connected to the second main pump via the branch passage including the check valve. Since the opening of the check valve is limited, a pressure loss in a path from the assist pump to the second main pump becomes larger than a pressure loss in a path from the assist pump to the first main pump, whereby a pressure balance between the both may be possibly lost.

If the pressure balance is lost, the operation feeling of an operator may be possibly deteriorated when the operation valves are operated by causing discharged oil from the assist pump to join discharged oil from the first and second main pumps.

It is an object of the present invention to provide a hybrid construction machine capable of keeping a balance of pressures joining a first main pump and a second main pump when an assist pump driven using a power source different from the one for the first and second main pumps is connected in parallel to the first and second main pumps.

According to one aspect of the present invention, a hybrid construction machine is provided. The hybrid construction machine includes a first main pump and a second main pump, a first circuit system connected to the first main pump via a first supply passage, a second circuit system connected to the second main pump via a second supply passage, a hydraulic motor connected to the second main pump, a motor generator adapted to be rotated by a drive force of the hydraulic motor, an assist pump adapted to be rotated by a drive force of the motor generator, a joint passage connected to the assist pump and branching off at an intermediate position into one branch passage and other branch passage, a first logic valve disposed between the one branch passage and the first supply passage, a second logic valve disposed in the second supply passage, a switching valve disposed in the other branch passage and switchable to a state where the assist pump is connected to the second supply passage on the upstream side of the second logic valve and a state where the second main pump is connected to the hydraulic motor, and a check valve provided downstream of the switching valve in the other branch passage and permitting only a flow from the assist pump to the second logic valve. A poppet diameter of the first logic valve is smaller than a poppet diameter of the second logic valve.

Embodiments of the present invention and advantages thereof are described in detail below with reference to the accompanying drawings.

DESCRIPTION OF EMBODIMENTS

Hereinafter, an embodiment of the present invention is described with reference to the drawings.

Figure 1:
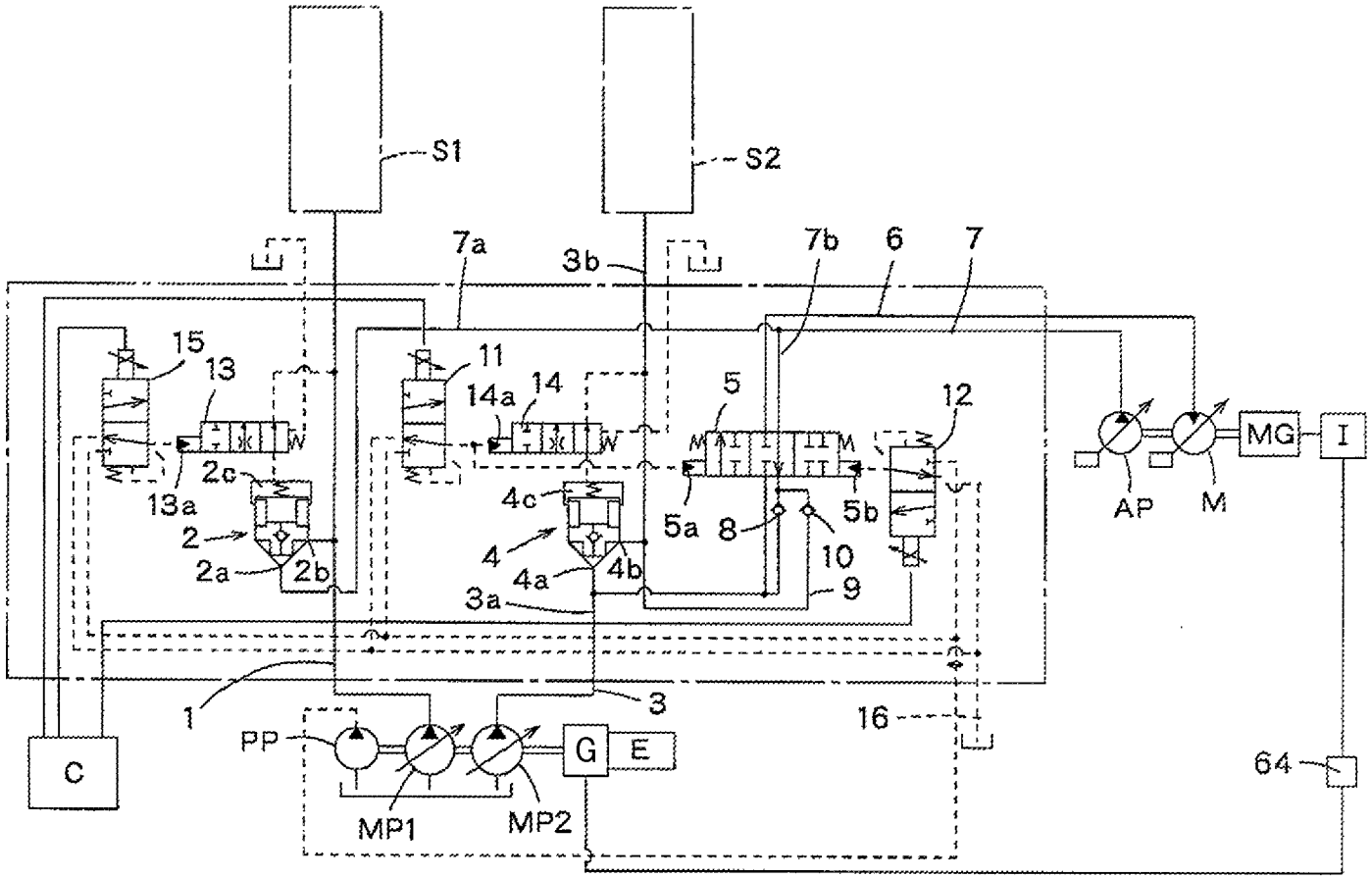
FIG. 1 is a circuit diagram showing a hydraulic control circuit of a hybrid construction machine according to an embodiment of the present invention.

FIG. 1 is a circuit diagram showing a hydraulic control circuit of a hybrid construction machine according to the embodiment of the present invention. A first main pump MP1 and a second main pump MP2 of a variable-capacity type which are coordinated with an engine E and a generator G which generates power with the rotation of the engine E are provided in the hydraulic control circuit.

The first main pump MP1 is directly connected to a first circuit system S1 including a plurality of operation valves via a first supply passage 1. Out of an input port 2*a* and an output port 2*b* provided in a first logic valve 2, the output port 2*b* is connected to the first supply passage 1.

The second main pump MP2 is connected to a second circuit system S2 including a plurality of operation valves by way of a second supply passage 3. A second logic valve 4 is provided at an intermediate position of the second supply passage 3. The second supply passage 3 is composed of an upstream supply passage 3*a* arranged upstream of the second logic valve 4 and a downstream supply passage 3*b* arranged downstream of the second logic valve 4. An input port 4*a* of the second logic valve 4 is connected to the upstream supply passage 3*a* and an output port 4*b* of the second logic valve 4 is connected to the downstream supply passage 3*b*. Thus, discharged oil from the second main pump MP2 is supplied to the second circuit system S2 by way of the second logic valve 4.

Further, the hydraulic control circuit includes an assist pump AP in addition to the first and second main pumps MP1, MP2. The assist pump AP is rotated by a drive force of a motor generator MG. The motor generator MG is rotated by a drive force of a hydraulic motor M. The hydraulic motor M is connected to the upstream supply passage 3*a* by way of a connection passage 6 connected to a switching valve 5.

A joint passage 7 is connected to the assist pump AP. The joint passage 7 is branched off into a branch passage 7*a* and a branch passage 7*b*.

One branch passage 7*a* is directly connected to the input port 2*a* of the first logic valve 2. Accordingly, discharged oil from the assist pump AP supplied to the one branch passage 7*a* is supplied to the first circuit system S1 by way of the first logic valve 2.

The other branch passage 7*b* is connected to the upstream supply passage 3*a* by way of the switching valve 5 and a check valve 8 provided downstream of the switching valve 5. The check valve 8 permits only a flow from the assist pump AP to the upstream supply passage 3*a*.

The switching valve 5 is a three-position switching valve. When being at a shown neutral position, the switching valve 5 keeps the branch passage 7*b* in a state of communication and cuts off the connection passage 6. This causes the discharged oil from the assist pump AP to be supplied to the input port 2*a* of the first logic valve 2 by way of the one branch passage 7*a* and to the upstream supply passage 3*a* by way of the other branch passage 7*b*.

When the switching valve 5 is switched to a shown left position, the branch passage 7*b* is cut off and the connection passage 6 is set in a state of communication. This allows the second main pump MP2 to communicate with the hydraulic motor M via the upstream supply passage 3*a* and the connection passage 6.

When the switching valve 5 is switched to a shown right position, both the connection passage 6 and the branch passage 7*b* are cut off.

Further, the branch passage 7*b* includes a bypass passage 9 branching off between the switching valve 5 and the check valve 8. The bypass passage 9 is directly connected to the downstream supply passage 3*b*. A check valve 10 for permitting only a flow from the assist pump AP to the downstream supply passage 3*b* is provided in the bypass passage 9.

The switching valve 5 includes a pilot chamber 5*a* and a pilot chamber 5*b*, an electromagnetic switching valve 11 is connected to the pilot chamber 5*a* and an electromagnetic switching valve 12 is connected to the pilot chamber 5*b*. A pilot pressure from a pilot pump PP is introduced to the switching valve 5 via the electromagnetic switching valves 11, 12. The switching valve 5 is switched to any one of the neutral position, the left position and the right position by the action of the pilot pressure.

A pilot chamber 2*c* of the first logic valve 2 is connected to the first supply passage 1 via an on-off valve 13. A pilot chamber 4*c* of the second logic valve 4 is connected to the downstream supply passage 3*b* via an on-off valve 14. The on-off valve 13, 14 has a fully open position, a closed position and a throttle control position and is switched to the fully open position, the closed position or the throttle control position according to a pilot pressure in the corresponding pilot chamber 13*a*, 14*a*.

Electromagnetic switching valves 15, 11 are connected to the respective pilot chambers 13*a*, 14*a* of the on-off valves 13, 14. The on-off valves 13, 14 are switched by the pilot pressure from the pilot pump PP introduced via the electromagnetic switching valves 15, 11. The electromagnetic switching valve 11 is also connected to one pilot chamber 5*a* of the switching valve 5.

When the electromagnetic switching valve 11 is at a neutral position shown in FIG. 1, the pilot chamber 5*a* of the switching valve 5 and the pilot chamber 14*a* of the on-off valve 14 respectively communicate with a drain passage 16. On the other hand, when a solenoid of the electromagnetic switching valve 11 is excited by a control signal from a controller C, the electromagnetic switching valve 11 is switched to a switch position. In this way, the pilot pressure of the pilot pump PP is introduced to the both pilot chambers 5*a*, 14*a*.

When the electromagnetic switching valve 15 is at a neutral position shown in FIG. 1, the pilot chamber 13*a* of the on-off valve 13 communicates with the drain passage 16. On the other hand, when a solenoid of the electromagnetic switching valve 15 is excited by a control signal from the controller C, the electromagnetic switching valve 15 is switched to a switch position. In this way, the pilot pressure of the pilot pump PP is introduced to the pilot chamber 13*a* of the on-off valve 13.

The controller C outputs a control signal corresponding to the operation of an operator. The operator can switch each of the electromagnetic switching valves 11, 12 and 15 to the switch position simultaneously and can also switch them individually.

In the case of causing the motor generator MG to fulfill a power generation function, the controller C outputs a control signal to switch the electromagnetic switching valve 11 to the switch position. When the electromagnetic switching valve 11 is switched to the switch position, the pilot pressure of the pilot pump PP is introduced to each of the one pilot chamber 5*a* of the switching valve 5 and the pilot chamber 14*a* of the on-off valve 14. At this time, the controller C keeps a solenoid of the electromagnetic switching valve 12 in a non-exciting state and allows the other pilot chamber 5*b* of the switching valve 5 to communicate with the drain passage 16.

When the pilot pressure is introduced to the pilot chamber 14*a* of the on-off valve 14, the on-off valve 14 is switched to the closed position by the action of the pressure in the pilot chamber 14*a*. Then, the pilot chamber 4*c* of the second logic valve 4 is closed, wherefore the second logic valve 4 is kept in a closed state.

Accordingly, the discharged oil from the second main pump MP2 is supplied to the hydraulic motor M by way of the connection passage 6 and the switching valve 5 without being introduced to the second circuit system S2, thereby rotating the hydraulic motor M. If the hydraulic motor M rotates, the motor generator MG rotates to generate power and the generated power is charged into a battery 64 via an inverter I. It should be noted that power generated by the generator G directly connected to the engine E is also stored into the battery 64.

On the other hand, in the case of causing the discharged oil from the assist pump AP to join the discharged oil from the first and second main pumps MP1, MP2, the controller C outputs a control signal to set all of the solenoids of the electromagnetic switching valves 11, 12 and 15 in the non-exciting state. In this way, the electromagnetic switching valves 11, 12 and 15 are kept at the shown neutral position and the pilot chambers 5*a*, 5*b* of the switching valve 5 and the pilot chambers 13*a*, 14*a* of the on-off valves 13, 14 communicate with the drain passage 16.

Since the pilot chamber 13*a* of the on-off valve 13 communicates with the drain passage 16, the on-off valve 13 is kept at the fully open position that is the shown neutral position. If the discharged oil from the assist pump AP flows into the first logic valve 2 from the branch passage 7*a* in this state, the first logic valve 2 is opened.

Thus, the discharged oil from the assist pump AP supplied to the branch passage 7*a* joins the first supply passage 1 by way of the first logic valve 2 and is supplied to the first circuit system S1.

Further, since the pilot chambers 5*a*, 5*b* of the switching valve 5 communicate with the drain passage 16 as described above, the switching valve 5 is kept at the shown neutral position and the branch passage 7*b* of the joint passage 7 and the bypass passage 9 communicate with the assist pump AP. At this time, since the pilot chamber 14*a* of the on-off valve 14 also communicates with the drain passage 16, the on-off valve 14 is kept at the fully open position that is the shown neutral position. If the on-off valve 14 is kept at the fully open position, the pilot chamber 4*c* of the second logic valve 4 communicates with the second supply passage 3, wherefore a pressure in the branch passage 7*b* acts on the second logic valve 4 to open the second logic valve 4.

Thus, the discharged oil from the assist pump AP is supplied from the branch passage 7*b* to the second circuit system S2 by way of the second logic valve 4 and directly supplied to the second circuit system S2 through the bypass passage 9.

Since the discharged oil from the assist pump AP is supplied to the second circuit system S2 by way of two passages, i.e. the branch passage 7*b* and the bypass passage 9 as just described, a pressure loss becomes relatively smaller.

It should be noted that since the check valve 10 is also provided in the bypass passage 9, a pressure loss of the bypass passage 9 also depends on the opening of the check valve 10. However, since the sum of the openings of the check valve 8 in the branch passage 7*b* and the check valve 10 in the bypass passage 9 constitutes a flow passage area, the pressure loss is smaller than in the case where there is only the branch passage 7*b*.

Further, it is also possible to control the opening of the electromagnetic switching valve 11 or 15 and keep either one of the on-off valves 13, 14 at the throttle control position between the closed position and the fully open position by the controller C outputting an operation signal according to the operation of the operator. In this case, the opening of the first or second logic valve 2 or 4 can be controlled according to throttle opening.

Figure 2:
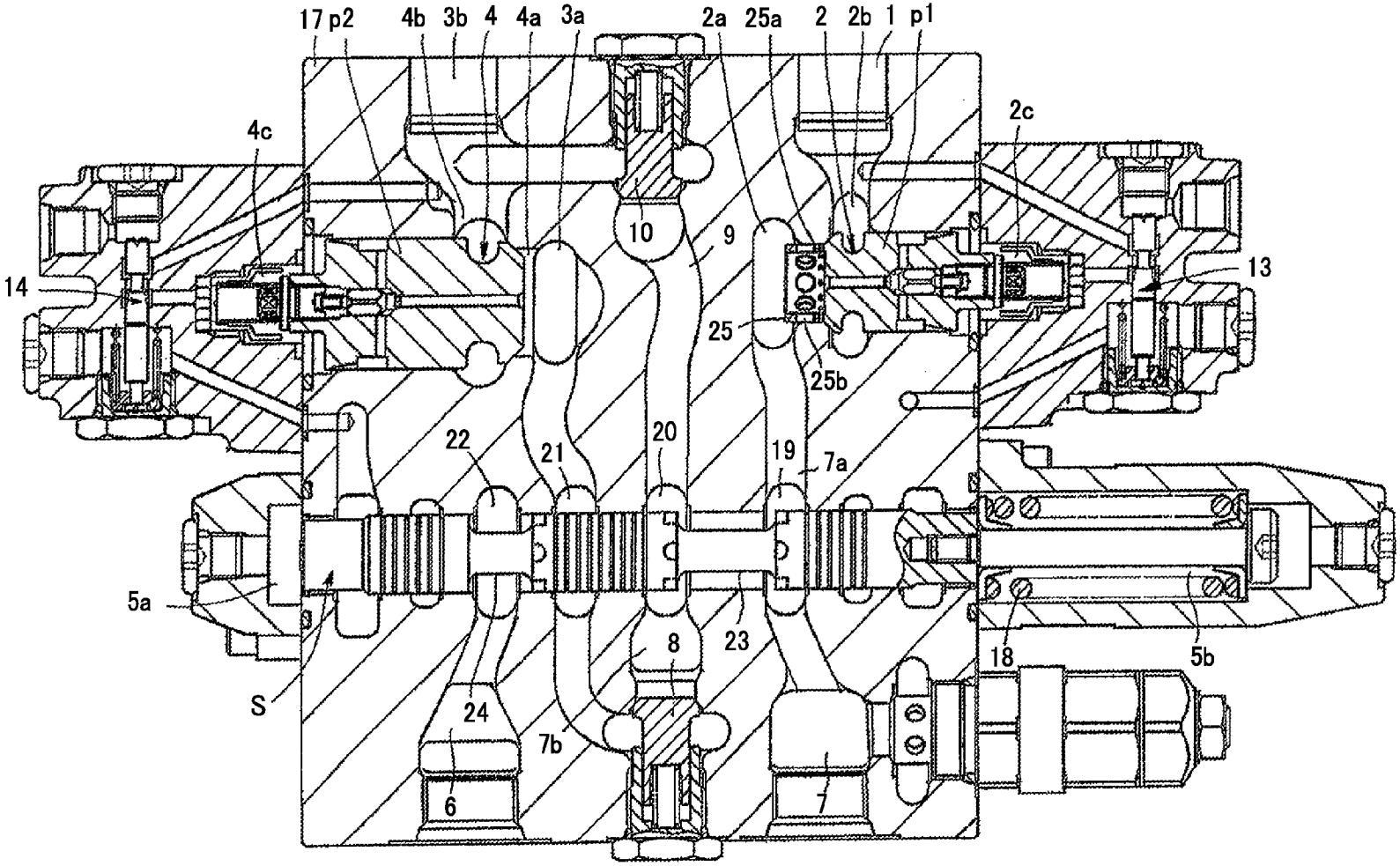
FIG. 2 is a sectional view showing a cross-section of a valve main body.

FIG. 2 is a sectional view showing a cross-section of a valve main body 17 including the above hydraulic control circuit.

A spool S of the switching valve 5 is slidably incorporated into the valve main body 17. The spool S is so arranged that both ends face the pilot chambers 5*a*, 5*b*. A centering spring 18 is provided in the pilot chamber 5*b*.

The valve main body 17 is formed with the input port 2*a* and the output port 2*b* of the first logic valve 2 incorporated into the valve main body 17 and the input port 4*a* and the output port 4*b* of the second logic valve 4 incorporated into the valve main body 17. Further, the valve main body 17 is formed with the connection passage 6 and the joint passage 7 connected to the assist pump AP. The one branch passage 7*a* of the joint passage 7 constantly communicates with the input port 2*a* of the first logic valve 2 regardless of the switch position of the spool S.

The upstream supply passage 3*a* of the second supply passage 3 is open in the valve main body 17 and communicates with the input port 4*a* of the second logic valve 4. First to fourth annular grooves 19 to 22 are successively formed from the right side of FIG. 2 around the spool S in the valve main body 17.

The first annular groove 19 is located at a branching point of the branch passages 7*a*, 7*b* formed in the valve main body 17. Thus, the branch passage 7*a* constantly communicates with the assist pump AP via the first annular groove 19 regardless of the switch position of the spool S.

The second annular groove 20 is located at a branching point of the branch passage 7*b* and the bypass passage 9 formed in the valve main body 17. The third annular groove 21 is located at an intermediate position of a passage allowing communication between the branch passage 7*b* and the upstream supply passage 3*a*. The fourth annular groove 22 is formed at an intermediate position of the connection passage 6.

Further, a first annular recess 23 and a second annular recess 24 are successively formed on the spool S from the right side of FIG. 2. The first annular recess 23 is arranged from the first annular groove 19 to the second annular groove 20 and keeps the first and second annular grooves 19, 20 in a state of communication when the spool S is at a neutral position shown in FIG. 2. In this state, the joint passage 7 communicating with the assist pump AP communicates with the branch passage 7*a* and with the branch passage 7*b* and the bypass passage 9 via the first annular groove 19, the first annular recess 23 and the second annular groove 20. Further, the fourth annular groove 22 faces the second annular recess 24 and is blocked from communication with the other passages.

If the pilot pressure acts on the one pilot chamber 5*a*, the spool S moves in a rightward direction of FIG. 2. If the spool S moves in the rightward direction of FIG. 2, the first annular recess 23 is displaced from the second annular groove 20, wherefore the communication of the branch passage 7*b* and the bypass passage 9 communicating with the second annular groove 20 with the assist pump AP is blocked.

At this time, since the second annular recess 24 is arranged from the third annular groove 21 to the fourth annular groove 22, the third and fourth annular grooves 21, 22 communicate. Thus, the connection passage 6 communicates with the upstream supply passage 3*a* via the fourth annular groove 22, the second annular recess 24 and the third annular groove 21.

Here, a poppet diameter of a poppet p1 of the first logic valve 2 is set to be smaller than that of a poppet p2 of the second logic valve 4.

As described with reference to FIG. 1, the on-off valve 13 controls the pilot pressure in the pilot chamber 2*c* of the first logic valve 2 and can be switched to the closed position, the throttle control position or the open position depending on the switch position of the electromagnetic switching valve 15. It should be noted that the electromagnetic switching valve 15 is not shown in FIG. 2.

Further, the poppet p 1 of the first logic valve 2 is formed with a tubular portion 25 and a plurality of small-diameter holes 25*a* and a plurality of large-diameter holes 25*b* are formed on the periphery of the tubular portion 25. If the poppet p1 is moved in a valve opening direction, the small-diameter holes 25*a* are first open to the output port 2*b* and then the large-diameter holes 25*b* are open to the output port 2*b*.

In this way, a pressure loss of pressure oil flowing in the first supply passage 1 can be adjusted by adjusting the hole diameters of the small-diameter holes 25*a* and the large-diameter holes 25*b* and the supplied oil can be equally distributed by equalizing pressure losses in the first and second supply passages 1, 3.

As described with reference to FIG. 1, the on-off valve 14 controls the pilot pressure in the pilot chamber 4*c* of the second logic valve 4 and can be switched to the closed position, the throttle control position or the open position depending on the switch position of the electromagnetic switching valve 11. It should be noted that the electromagnetic switching valve 11 is not shown in FIG. 2.

Next, a case is described where hydraulic oil is discharged from the assist pump AP with all of the electromagnetic switching valves 11, 12 and 15 kept at the neutral position shown in FIG. 1.

If the electromagnetic switching valves 11, 12 are set to the neutral position, the spool S is kept at the neutral position shown in FIG. 2 and the on-off valves 13, 14 are kept at the open position that is the neutral position.

If the discharged oil from the assist pump AP is supplied to the joint passage 7 in this state, the discharged oil is supplied to the branch passages 7*a*, 7*b*.

The discharged oil supplied to the branch passage 7*a* flows into the input port 2*a* of the first logic valve 2. At this time, since the on-off valve 13 is kept at the open position, the first logic valve 2 is opened by the pressure on the side of the input port 2*a* and the large-diameter holes 25*b* are open to the output port 2*b*. In this way, the discharged oil from the assist pump AP introduced to the branch passage 7*a* is introduced to the first supply passage 1 via the output port 2*b*, joins the discharged oil from the first main pump MP1 and is supplied to the first circuit system S1.

The discharged oil from the assist pump AP supplied from the second annular groove 20 to the branch passage 7*b* is introduced to the upstream supply passage 3*a* by way of the check valve 8 provided in the branch passage 7*b*, joins the discharged oil from the second main pump MP2 and is introduced to the input port 4*a* of the second logical valve 4. At this time, since the on-off valve 14 is kept at the open position, the second logic valve 4 is opened by the pressure of the joined oil introduced to the input port 4*a*. In this way, the joined oil introduced to the input port 4*a* is introduced to the output port 4*b* and flows out to the downstream supply passage 3*b* from the output port 4*b*.

The discharged oil from the assist pump AP introduced from the second annular groove 20 to the bypass passage 9 flows out to the downstream supply passage 3*b* by way of the check valve 10. That is, the discharged oil from the assist pump AP introduced to the second annular groove 20 flows in two separate routes, i.e. a route in which the discharged oil is introduced from the branch passage 7*b* to the downstream supply passage 3*b* by way of the second logic valve 4 and a route in which the discharged oil is introduced to the downstream supply passage 3*b* by way of the bypass passage 9. These routes join at the downstream supply passage 3*b*.

Accordingly, a pressure loss does not become very large even if the check valves 8, 10 are respectively provided in the branch passage 7*b* and the bypass passage 9.

In addition, since the poppet diameter of the poppet p1 of the first logic valve 2 is set to be smaller than that of the poppet p2 of the second logic valve 4, the pressure loss of the first logic valve 2 is larger when the both logic valves 2, 4 are simultaneously opened.

As just described, the pressure loss of the passing hydraulic oil is made relatively larger by making the poppet diameter of the poppet p 1 of the first logic valve 2 relatively smaller on the branch passage 7*a* side where no check valve is provided, whereas the pressure loss is made smaller by providing the bypass passage 9 in parallel on the branch passage 7*b* side. That is, since the pressure losses of the pressure oil introduced from the assist pump AP to the both circuit systems S1, S2 can be adjusted by actively making the pressure loss larger on one side and making the pressure loss smaller on the other side, the deterioration of the operation feeling of the operator can be suppressed.

It should be noted that, if the on-off valves 13, 14 are switched to the throttle control position, the openings of the first and second logic valves 2, 4 can be controlled according to the throttle openings of the on-off valves 13, 14. Particularly, by switching the on-off valve 13 to the throttle control position, the opening of the first logic valve 2 can be controlled to the opening, at which only the small-diameter holes 25*a* are open, according to the throttle opening.

Accordingly, the pressure losses of the pressure oil introduced to the first and second circuit systems S1, S2 can be controlled under various conditions. For example, in the case of prioritizing an operating speed of a specific cylinder provided in the first circuit system S1 at the time of excavation by a power shovel, the pressure oil can be preferentially supplied to the first circuit system S1 by making the opening of the first logic valve 2 relatively larger.

On the other hand, the on-off valve 14 is kept at the closed position when the electromagnetic switching valve 11 is kept at the switch position and the electromagnetic switching valve 12 is kept at the neutral position shown in FIG. 1. Since this causes the pilot chamber 4*c* of the second logic valve 4 to be closed, the second logic valve 4 is kept in the closed state even if a pressure acts on the input port 4*a*.

Further, the pilot pressure is introduced to the one pilot chamber 5*a* of the switching valve 5 and the other pilot chamber 5*b* communicates with the drain passage 16. The spool S is moved in the rightward direction of FIG. 2 by the pressure in the one pilot chamber 5*a* and the switching valve 5 is switched to the left position of FIG. 1. This causes the upstream supply passage 3*a* and the connection passage 6 to communicate via the second annular recess 24 as shown in FIG. 2.

Accordingly, the discharged oil from the second main pump MP2 is introduced from the upstream supply passage 3*a* to the connection passage 6 by way of the third annular groove 21, the second annular recess 24 and the fourth annular groove 22, and supplied to the hydraulic motor M from the connection passage 6. If the discharged oil from the second main pump MP2 is introduced to the hydraulic motor M, the hydraulic motor M rotates and the motor generator MG rotates to fulfill the power generation function.

It should be noted that, in the case of causing the motor generator MG to generate power by rotating the hydraulic motor M as described above, power generation efficiency can be increased by setting an angle of inclination of the assist pump AP to zero to set the discharge amount to zero.

On the other hand, when the electromagnetic switching valve 11 is kept at the neutral position shown in FIG. 1 and the electromagnetic switching valve 12 is switched to the switch position, the one pilot chamber 5*a* of the switching valve 5 communicates with the drain passage 16 and the other pilot chamber 5*b* communicates with the pilot pump PP. The spool S is moved in a leftward direction of FIG. 2 by the pressure in the pilot chamber 5*b* and the switching valve 5 is switched to the right position of FIG. 1. In this way, the communication between the hydraulic motor M and the second main pump MP2 is blocked and the communication of the assist pump AP with the branch passage 7*b* and the bypass passage 9 is blocked. In this case, the discharged oil from the assist pump AP is supplied only to the first logic valve 2 by way of the branch passage 7*a*.

The embodiments of the present invention described above are merely illustration of some application examples of the present invention and not of the nature to limit the technical scope of the present invention to the specific constructions of the above embodiments.

The present application claims a priority based on Japanese Patent Application No. 2012-022286 filed with the Japan Patent Office on Feb. 3, 2012, all the contents of which are hereby incorporated by reference.

The invention claimed is:

1. A hybrid construction machine, comprising:

a first main pump and a second main pump;

a first circuit system connected to the first main pump via a first supply passage;

a second circuit system connected to the second main pump via a second supply passage;

a hydraulic motor connected to the second main pump;

a motor generator adapted to be rotated by a drive force of the hydraulic motor;

an assist pump adapted to be rotated by a drive force of the motor generator;

a joint passage connected to the assist pump and branching off at an intermediate position into one branch passage and other branch passage;

a first logic valve disposed between the one branch passage and the first supply passage;

a second logic valve disposed in the second supply passage;

a switching valve disposed in the other branch passage and switchable to a state where the assist pump is connected to the second supply passage on the upstream side of the second logic valve and a state where the second main pump is connected to the hydraulic motor; and a check valve provided downstream of the switching valve in the other branch passage and permitting only a flow from the assist pump to the second logic valve, wherein a poppet diameter of the first logic valve is smaller than a poppet diameter of the second logic valve.

2. The hybrid construction machine according to claim 1, wherein:

an on-off valve is provided in a pilot chamber of the first logic valve; and the on-off valve is switchable to any one of a fully open position, a closed position and a throttle control position.

3. The hybrid construction machine according to claim 1, wherein:

an on-off valve is provided in a pilot chamber of the second logic valve; and the on-off valve is switchable to any one of a fully open position, a closed position and a throttle control position.

4. The hybrid construction machine according to claim 1, wherein:

a poppet of the first logic valve is formed with a tubular portion; and a plurality of small-diameter holes are formed at a front side in a valve opening direction of the poppet and a plurality of large-diameter holes are formed at a rear side in the valve opening direction on the periphery of the tubular portion.

* * * * *